US012617011B2

(12) United States Patent
Iizuka et al.

(10) Patent No.: US 12,617,011 B2
(45) Date of Patent: May 5, 2026

(54) METHOD FOR MANUFACTURING PRESSED COMPONENT, METHOD FOR MANUFACTURING BLANK MATERIAL, AND STEEL SHEET

(71) Applicant: JFE STEEL CORPORATION, Tokyo (JP)

(72) Inventors: Eiji Iizuka, Tokyo (JP); Toyohisa Shinmiya, Tokyo (JP); Takeshi Ogawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 270 days.

(21) Appl. No.: 17/913,742

(22) PCT Filed: Mar. 18, 2021

(86) PCT No.: PCT/JP2021/011181
§ 371 (c)(1),
(2) Date: Sep. 22, 2022

(87) PCT Pub. No.: WO2021/200233
PCT Pub. Date: Oct. 7, 2021

(65) Prior Publication Data

US 2023/0113628 A1 Apr. 13, 2023

(30) Foreign Application Priority Data

Mar. 31, 2020 (JP) ..... 2020-063178

(51) Int. Cl.
*B21D 22/26* (2006.01)

(52) U.S. Cl.
CPC ..... *B21D 22/26* (2013.01)

(58) Field of Classification Search
CPC ..... B21D 22/02; B21D 22/20; B21D 22/26
See application file for complete search history.

(56) References Cited

U.S. PATENT DOCUMENTS 9,145,594 B2 * 9/2015 Toji ..... B21D 22/02
10,124,387 B2 11/2018 Nakazawa et al.
(Continued)

FOREIGN PATENT DOCUMENTS

CN 108136474 A 6/2018
CN 109642295 A 4/2019
(Continued)

OTHER PUBLICATIONS

Mori et al., "Small Hole Punching Using Local Resistance Heating for Die-Quenched Steel Sheets," Journal of the ISTP, 2011, vol. 52, No. 609, (Oct. 2011) pp. 1114-1118.
(Continued)

*Primary Examiner* — Teresa M Ekiert
(74) *Attorney, Agent, or Firm* — OLIFF PLC.

(57) ABSTRACT

A technology capable of suppressing end cracking due to a delayed fracture without restrictions on the target pressed component shape. When it is estimated that the end cracking due to the delayed fracture in an end of a material to be pressed is concerned, double cutting processing including performing cutting processing of the end containing at least a place where the end cracking is concerned twice is provided as preprocessing for the press forming causing the concern about the end cracking. The double cutting processing includes performing, in first cutting, cutting to form a partial beam-shaped projection portion at a position containing the place where the end cracking is concerned, and cutting the projection portion in second cutting.

18 Claims, 6 Drawing Sheets

(56) References Cited

U.S. PATENT DOCUMENTS

| | | | | |
|---|---|---|---|---|
| 11,224,908 | B2 | 1/2022 | Yasutomi et al. | |
| 11,268,164 | B2 | 3/2022 | Yoshioka et al. | |
| 11,931,788 | B2 | 3/2024 | Ogawa et al. | |
| 2009/0177417 | A1* | 7/2009 | Yonemura | G06F 30/15 702/42 |
| 2016/0169791 | A1* | 6/2016 | Oetjens | G06F 30/23 702/48 |
| 2016/0193644 | A1 | 7/2016 | Nakazawa et al. | |
| 2017/0140080 | A1* | 5/2017 | Oetjens | G06F 30/20 |
| 2018/0272408 | A1 | 9/2018 | Yasutomi et al. | |
| 2019/0105697 | A1 | 4/2019 | Nakazawa et al. | |
| 2019/0203317 | A1 | 7/2019 | Yoshioka et al. | |
| 2022/0040748 | A1 | 2/2022 | Ogawa et al. | |

FOREIGN PATENT DOCUMENTS

| | | | |
|---|---|---|---|
| CN | 113365752 | A | 9/2021 |
| EP | 3919198 | A1 | 12/2021 |
| JP | S63-080026 | U | 5/1988 |
| JP | H01197018 | A | 8/1989 |
| JP | H02-034226 | A | 2/1990 |
| JP | 2506400 | B2 | 6/1996 |
| JP | 2004-174542 | A | 6/2004 |
| JP | 2005351693 | A | 12/2005 |
| JP | 2006231425 | A | 9/2006 |
| JP | 6090464 | B2 | 3/2017 |
| WO | 2015/041009 | A1 | 3/2015 |
| WO | 2017/038579 | A1 | 3/2017 |

OTHER PUBLICATIONS

Mori et al., "Punching of Ultra High Strength Steel Sheets Using Local Resistance Heating," Journal of the JSTP, vol. 51, No. 588, (Jan. 2010), pp. 55-59.

"Sendankakou No. saizensen," Proceedings of the 326th Symposium on Plasticity, 2018, pp. 21-28.

Murakawa et al., "Precision piercing and blanking of ultrahigh-strength steel sheets," Procedia Engineering, 2014, vol. 81, pp. 1114-1120.

Sep. 29, 2022 International Preliminary Report on Patentability issued in International Patent Application No. PCT/JP2021/011181.

Apr. 27, 2021 Search Report issued in International Patent Application No. PCT/JP2021/011181.

Sep. 7, 2021 Office Action issued in Japanese Patent Application No. 2021-536795.

Takeo Nakagawa and Kiyota Yoshida, "Cut-Off Punching Process—A New Method for Recovery of Stretchability of Sheared Edge", Sosei to Kako, vol. 10, No. 104, (Sep. 1969), pp. 665-671 and 698.

Aug. 25, 2023 Search Report issued in European Patent Application No. 21782063.8.

Jul. 25, 2024 Office Action issued in Chinese Patent Application No. 202180026260.4.

Jan. 9, 2025 Office Action issued in Chinese Patent Application No. 202180026260.4.

* cited by examiner

METHOD FOR MANUFACTURING PRESSED COMPONENT, METHOD FOR MANUFACTURING BLANK MATERIAL, AND STEEL SHEET

TECHNICAL FIELD

The present invention is a technology related to the manufacture of a pressed component having a component shape with concern about the occurrence of a delayed fracture in press forming.

The present invention is a technology particularly suitable for the manufacture of a pressed component using metal sheets containing high-strength steel sheets having a tensile strength of 980 MPa or more.

BACKGROUND ART

At present, automobiles have been required to improve fuel consumption by a reduction in weight and collision safety. For the purpose of achieving both the reduction in weight of a vehicle body and the protection of passengers in the event of a collision, high-strength steel sheets tend to be used for structural components for automobiles. Particularly in recent years, as the high-strength steel sheets, ultrahigh-strength steel sheets having higher strength, i.e., having a tensile strength of 980 MPa or more, have been applied to the vehicle body.

A delayed fracture is one of the problems when the high-strength steel sheets are applied to the vehicle body. In particular, a delayed fracture occurring from the end surface after shearing work (hereinafter also referred to as sheared end surface) is a serious problem in high-strength steel sheets having a tensile strength of 1180 MPa or more among the high-strength steel sheets.

Herein, it is known that a large tensile stress remains in the sheared end surface. The remaining of the tensile stress causes concern about the occurrence of the delayed fracture in the sheared end surface with time in a product after pressing (pressed component). To suppress the delayed fracture in the sheared end surface, it is required to reduce the tensile residual stress in the sheared end surface.

As a method for reducing the tensile residual stress of the sheared end surface, a method for raising the steel sheet temperature in shearing work (NPLS 1, 2), a method using a stepped punch in punching work (NPL 3), and a method using shaving (NPL 4, PTL 1) are mentioned, for example.

However, the method for raising the steel sheet temperature in the shearing work requires time to heat the steel sheet. Therefore, this method is not suitable for a mass production step of automobiles and the like. The method using a stepped punch has a problem that an effect of improving a delayed fracture resistance property is low. The method using shaving has a problem of difficulty to manage the clearance in a shaving step.

NPL 5 describes a cut-off punching method by double punching. However, the method of NPL 5 is a punching work technology, and thus cannot be applied to an outer peripheral portion of a product.

CITATION LIST

Non Patent Literatures

NPL 1: Kenichiro Mori et al.: Sosei to Kako, 52-609 (2011), 1114-1118

NPL 2: Kenichiro Mori et al.: Sosei to Kako, 51-588 (2010), 55-59

NPL 3: 326th Symposium on Technology of Plasticity "Sendankako no saizensen", 21-28

NPL 4: M. Murakawa, M. Suzuki, T. Shinome, F. Komuro, A. Harai, A. Matsumoto, N. Koga: Precision piercing and blanking of ultrahigh-strength steel sheets, Procedia Engineering, 81 (2014), pp. 1114-1120

NPL 5: Sosei to Kako, Vol. 10, no. 104 (1969-9)

Patent Literature

PTL 1: JP 2004-174542 A

SUMMARY OF INVENTION

Technical Problem

The present invention has been made focusing on the above-described points. It is an object of the present invention to provide a technology capable of suppressing a delayed fracture occurring with time while suppressing the occurrence of restrictions on the target pressed component shape.

Solution to Problem

To solve the problems, one aspect of the present invention is a method for manufacturing a pressed component including manufacturing a pressed component through one or two or more times of press forming, and the method includes: when it is estimated that at least one press forming of the one or two or more times of press forming causes concern about a delayed fracture in an end of a material to be pressed, double cutting processing including performing cutting processing of the end containing at least a place where the delayed fracture is concerned twice as preprocessing for the press forming causing concern about end cracking due to the delayed fracture, in which the double cutting processing includes performing, in first cutting, cutting to form a partial beam-shaped projection portion at a position containing the place where the delayed fracture is concerned, and cutting the projection portion in second cutting.

Another aspect of the present invention is a method for manufacturing a blank material to be formed into a pressed component through one or two or more times of press forming, and the method includes: when it is estimated that at least one press forming of the one or two or more times of press forming causes concern about end cracking due to a delayed fracture in an end of a material to be pressed, double cutting processing including performing cutting processing of the end containing at least a place where the delayed fracture is concerned twice, in which the double cutting processing includes performing, in first cutting, cutting to form a partial beam-shaped projection portion at a position containing the place where the delayed fracture is concerned, and cutting the projection portion in second cutting.

Advantageous Effects of Invention

According to the aspects of the present invention, it is possible to suppress the delayed fracture after the press forming while suppressing the occurrence of restrictions on the target pressed component shape.

DESCRIPTION OF EMBODIMENTS

Embodiments of the present invention will now be described with reference to the drawings.

A method for manufacturing a pressed component of this embodiment is a method for manufacturing a pressed component including manufacturing a target pressed component through one or two or more times of press forming. The press forming in each press forming is performed by stamping or drawing, for example. The method for manufacturing a pressed component of this embodiment is a technology in which a delayed fracture occurs, in at least one press forming, along the sheet edge after the press forming.

Figure 1A:
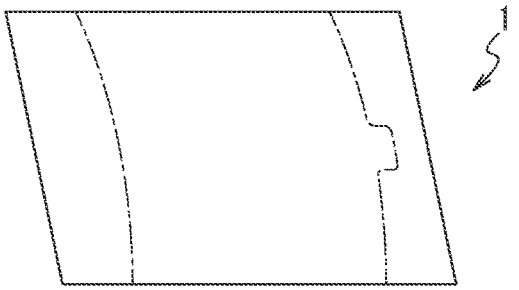
FIGS. 1A to 1D are conceptual vies for explaining double cutting processing and subsequent press forming according to an embodiment based on the present invention.
Figure 1B:
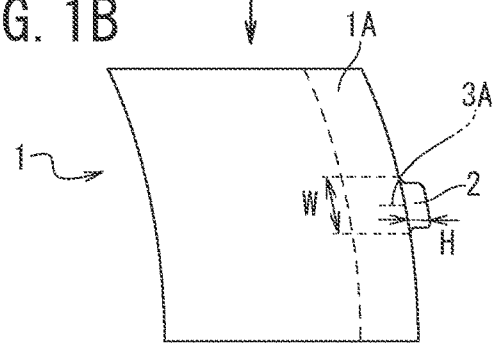
Figure 1C:
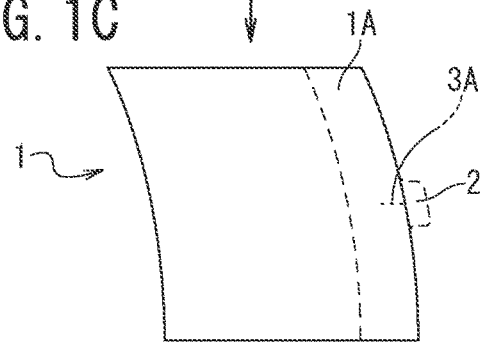
Figure 1C:
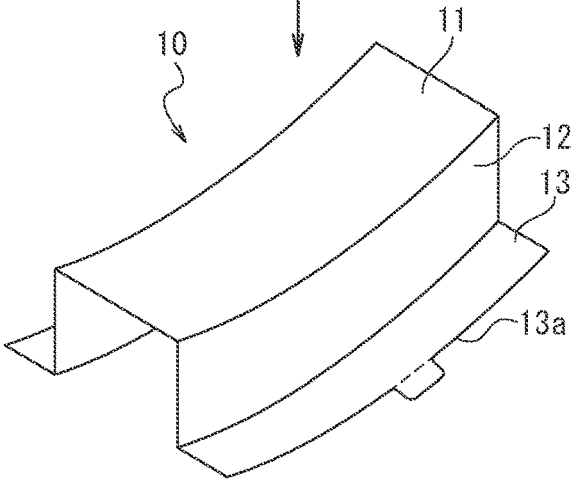
Figure 1D:
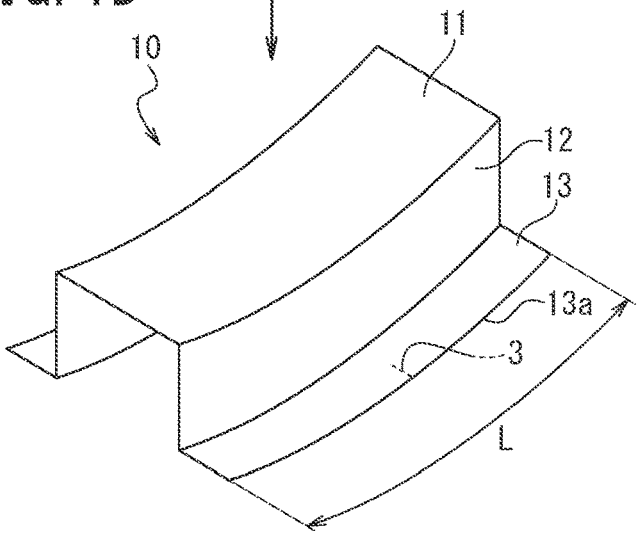

For simplicity of the description, this embodiment gives the description taking, as an example, a case where a pressed component 10 having the shape illustrated in FIG. 1D is manufactured in one press forming (one press step).

The component shape of the pressed component 10 illustrated in FIG. 1D has a top sheet portion 11, a vertical wall portion 12 continuous to the top sheet portion 11, and a flange portion 13 continuous to the vertical wall portion 12. The component shape of the pressed component 10 illustrated in FIG. 1D has a shape of being curved to project to the right side in FIGS. 1A to 1D in a top view along the longitudinal direction.

Figure 2A:
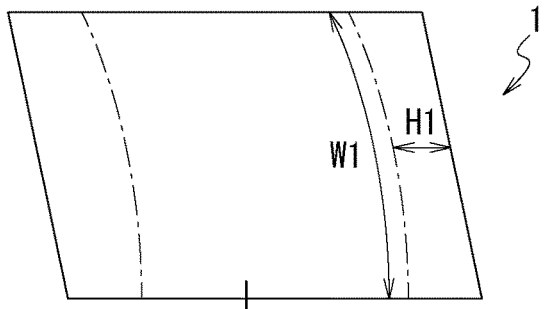
FIGS. 2A, 2C, and 2D are conceptual views for explaining press forming to which the present invention is not applied.
Figure 2C:
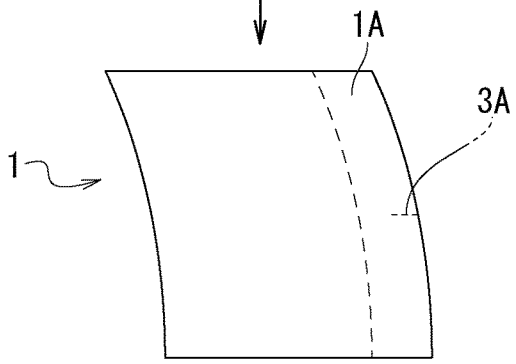
Figure 2D:
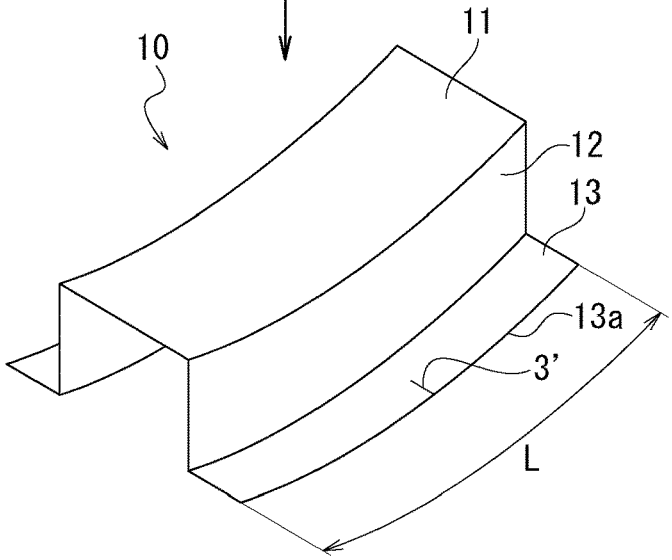

It is supposed in this example that, when press forming to which the present invention is not applied is carried out (when a step of FIG. 1B is omitted as illustrated in FIGS. 2A, 2C, and 2D), a flange portion 13 on the curved projection side partially has a portion with concern about cracking where end cracking due to the delayed fracture is concerned. In FIG. 1D, the reference numeral 3 indicates the position of the portion with concern about cracking due to the delayed fracture. In FIG. 2D, the reference numeral 3' indicates the position corresponding to the portion with concern about cracking where the end cracking has actually occurred due to the delayed fracture. The reference numeral 3A in FIGS. 1B, 1C, and 2C indicates the position of the portion with concern about cracking 3 due to the delayed fracture in a material to be pressed.

The reference numeral 1A indicates a flange corresponding portion corresponding to a region formed into the flange portion 13 in a material to be pressed 1. Herein, this embodiment describes, as an example, a case where the position of the portion with concern about cracking 3 due to the delayed fracture is located on the end surface formed by the flange portion 13, but the present invention is not limited thereto. It is also assumed that the position of the portion with concern about cracking 3 due to the delayed fracture is located on a sheared surface other than the end surface of the flange portion.

Herein, it is known that a large tensile stress remains in the sheared end surface. The remaining of the tensile stress causes concern about the occurrence of the delayed fracture in the sheared end surface with time in a product after pressing (pressed component). In the end where a compression stress is input in the press forming, the tensile residual stress is generated after the pressing, causing concern about the occurrence of the delayed fracture with time in the product after the pressing (pressed component). Therefore, in the end, which is the sheared end surface and in which the compression stress is input in the pressing, the occurrence of the delayed fracture is particularly concerned.

The confirmation of the presence or absence of the portion with concern about cracking 3 due to the delayed fracture and the specification of the position of the portion with concern about cracking 3 are obtained by carrying out a simulation analysis, such as a CAE analysis, for example. It may be acceptable that the press forming is actually carried out, and then a component after each press forming is observed to confirm the presence or absence of the portion with concern about cracking 3 due to the delayed fracture and specify the position of the portion with concern about cracking 3.

As described above, in the case of the simulation analysis, the delayed fracture may be evaluated by calculating the tensile residual stress after die release. In the case of the actual pressing, a produced sample is measured for the tensile residual stress value of the sheared end surface by X-rays for the evaluation of the delayed fracture, for example. Alternatively, the produced sample is dipped in hydrochloric acid having a pH of 3 for 96 hours, and then the delayed fracture is evaluated based on the presence or absence of the end cracking and the size of cracking in the resultant sample.

This embodiment has, as preprocessing for performing the press forming, a trimming step of shearing the outer periphery of the blank material 1 as an example of the material to be pressed into a profile shape according to the component shape of the pressed component 10.

However, in this embodiment, this trimming step applies double cutting processing of carrying out double cutting based on the present invention as illustrated in FIGS. 1B and 1C to the end of the flange corresponding portion equivalent to the flange portion 13 where the end cracking due to the delayed fracture is concerned (at least the position of the portion with concern about cracking 3).

The end position where the end cracking due to the delayed fracture is concerned is a part having the tensile residual stress after the die release of the press forming.

Therefore, the CAE analysis or the like sets, for the target pressed component, a case where the tensile residual stress equal to or larger than a predetermined tensile residual stress is generated as a case where it is estimated that the end cracking due to the delayed fracture is concerned in the end and sets a place where the tensile residual stress equal to or larger than a predetermined tensile residual stress is generated as a place where the delayed fracture is concerned, for example. Further, a place where the delayed fracture has occurred when the present invention is not applied is set as a place where the delayed fracture is concerned, for example.

In this embodiment, the end of the flange corresponding portion 1A to which the double cutting processing is applied in the blank material 1 which is the material to be pressed is cut in first cutting, such that a partial beam-shaped projection portion 2 is formed at a position containing a place where the end cracking due to the delayed fracture is concerned as illustrated in FIG. 1B. Subsequently, in second cutting, the projection portion 2 is cut, so that the blank material 1 is formed to have the target edge profile shape as illustrated in FIG. 1C.

More specifically, in this embodiment, when the blank material 1 is cut into the target profile shape in the trimming step, the side (edge) of the flange corresponding portion 1A is cut once into a shape having the projection portion 2 partially projecting in a cantilevered beam shape at the position containing the portion with concern about cracking 3A. Subsequently, the projection portion 2 is cut in the second cutting, so that the target profile shape is achieved. As described above, the cutting processing in FIG. 2C illustrating conventional processing is carried out in two step of FIGS. 1B and 1C in this embodiment. The steps of FIGS. 1B and 1C may be carried out in one step.

The double cutting processing based on the present invention may be carried out independently from the trimming step. For example, it may be acceptable that a plurality of steps (not illustrated) is provided between the steps of FIGS. 1C and 1D, and the double cutting processing based on the present invention is carried out during the plurality of steps.

Herein, a width W (length along the edge of the material) of the projection portion 2 is preferably set to ⅓ or less of a length L along the edge of the flange portion 13 or 150 times or less the sheet thickness of the blank material 1.

By forming the temporary beam-shaped projection portion 2 having the width W in the first cutting (shearing), a strain input by the shearing into the portion with concern about cracking 3 can be more certainly suppressed while gaining the cutting amount (punching margin) of the second cutting (shearing), as compared with a case of not temporarily forming the beam-shaped projection portion 2 (see FIGS. 2A, 2C, and 2D) (see examples described below).

The lower limit of the width W of the projection portion 2 is not particularly limited insofar as the position where the generation of the portion with concern about cracking 3 is estimated and the shearing can be performed. The lower limit of the width W is equal to or larger than the amount of opening in the edge resulting from the end cracking due to the delayed fracture, for example. The width W of the projection portion 2 is preferably 20 mm or more considering the ease of cutting by shearing.

The projection amount H of the projection portion 2 (maximum value of the projection amount from the target profile position) is 10 times or less the sheet thickness of the blank material 1 or 5.0 mm or less.

By setting a second cut portion as the cantilevered beam-shaped projection portion 2, the strain input by the shearing into the portion with concern about cracking 3 can be more certainly suppressed while gaining the cutting amount (punching margin) of the second cutting (shearing).

The lower limit of the projection amount H of the projection portion 2 is not particularly limited insofar as the projection portion 2 projects by more than 0 mm and the shearing can be performed. The lower limit of the projection amount H is preferably 1 mm or more and more preferably 3 mm or more considering the ease of shearing.

Then, after the double cutting processing above, the target pressed component 10 is manufactured by the press forming.

By performing the double cutting processing above as the preprocessing for the press forming causing the concern about the end cracking, cracking in the portion with concern about cracking 3 due to the delayed fracture can be prevented using common press forming without restricting the component shape.

Herein, the description above is given taking the case where the above-described double cutting processing is carried out as the preprocessing for the press forming as an example. However, a configuration may be acceptable in which the press forming into the target component shape is performed (FIG. 1C'), and then the second cutting (cutting of the projection portion 2) is carried out (FIG. 1D) as illustrated in FIGS. 1B→1C'→1D. The same effects are obtained.

The description above gives the case where the portion with concern about cracking 3 is present in one place as an example, but the present invention is applicable even when the portions with concern about cracking 3 due to the delayed fracture are present in two or more places. For each of the portions with concern about cracking 3, the above-described double cutting processing may be performed as the preprocessing for the press forming causing the concern about the end cracking. When the adjacent portions with concern about cracking 3 are close to each other, one projection portion 2 containing the adjacent portions with concern about cracking 3 may be formed in the first cutting.

Herein, the operations/effects of the double cutting processing including cutting the partial cantilevered beam-shaped projection portion, which is formed in the first cutting, in the second cutting are described.

In general, when shearing work is performed, a large tensile stress remains in the edge of the material to be pressed. Therefore, when press forming is carried out which causes the generation of the tensile residual stress in an end 13*a* of the flange portion 13 along the edge of the flange portion 13, a possibility that the end cracking occurs tends to increase.

To address the problem, by applying the double cutting processing based on the present invention to a part with concern about the occurrence of the end cracking due to the delayed fracture, the tensile residual stress in the sheared end surface decreases (see examples). As a result, this embodiment can prevent the end cracking due to the delayed fracture caused by the tensile residual stress while preventing the occurrence of restrictions on the component shape.

Herein, as illustrated in FIGS. 2A, 2C, and 2D illustrating an example of the conventional processing, when the end at a position where a flange is formed in one cutting by shearing, the cutting is performed at the cutting position illustrated by the alternate long and short dash line illustrated in FIG. 2A (cutting position on the right side), and therefore the cutting area containing a width W1 and a projection amount H1 from the cutting position of a cut portion is large.

To address the problem, as illustrated in FIGS. 1A to 1D, in the case of the double cutting processing including forming the partial beam-shaped projection portion 2 in the first cutting (cutting at the position illustrated by the alternate long and short dash line in FIG. 1A), and cutting the projection portion 2 in the second cutting based on the present invention, the cutting area containing the width W and the projection amount H of the cut portion in the second cutting is small (see FIGS. 1B, 1C). Then, in the double cutting processing based on the present invention, the partial cantilevered beam-shaped projection portion 2 is formed in the first cutting, so that, in the cut portion (projection portion 2) to be cut in the second cutting, the width W of the cut portion is significantly small and the cut portion projects in a cantilevered beam shape as illustrated in FIG. 1B. Therefore, when the projection portion 2 is cut in the second cutting, a distortion of a steel sheet in the direction where the cutting progresses increases, and the strain input in the cutting is relaxed, so that a strain of a greatly deformed region in the cutting is relaxed, and thus it is estimated that the tensile residual stress can be relaxed.

The delayed fracture is more likely to occur in materials having a higher tensile strength, and therefore the present invention is suitable for high-tensile steel sheets having a tensile strength of 590 MPa or more, for example. However, as the material of the blank material 1, the present invention is applicable not only to steel but to iron alloys, such as stainless steel, and further non-iron materials and non-metal materials. The pressed component 10 manufactured according to this embodiment is suitable as automobile components, for example, but the present invention is applicable to all types of work of press forming a sheet material without being limited to the automobile components.

The embodiment above describes the case where the target pressed component 10 is manufactured in one-stage press forming as an example. In general, the more complicated the component shape of the pressed component, the more likely it is to manufacture the target pressed component through two or more times of press forming (a plurality of times of pressing step). When the target pressed component is manufactured by the plurality of times of press forming, the press forming causing the delayed fracture is not necessarily the final step. The delayed fracture sometimes occurs individually in press forming having two or more stages.

For example, in the manufacture of the target pressed component through press forming having five stages, when a simulation, such as the CAE, estimates that the tensile stress equal to or larger than a predetermined tensile stress remains in the press forming in the fourth stage, causing the concern about the delayed fracture, the above-described double cutting processing may be carried out before the press forming in the fourth stage.

Figure 3A:
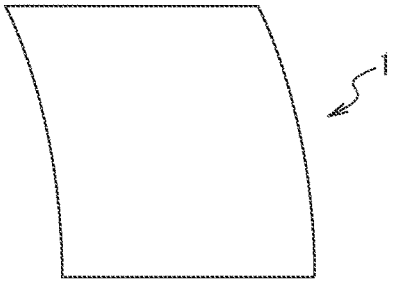
FIGS. 3A to 3E are conceptual views illustrating, as an example, a case where the double cutting processing based on the present invention is performed during work.
Figure 3D:
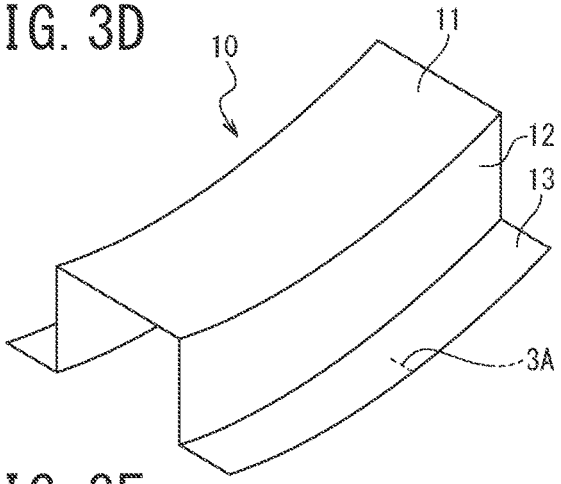
Figure 3B:
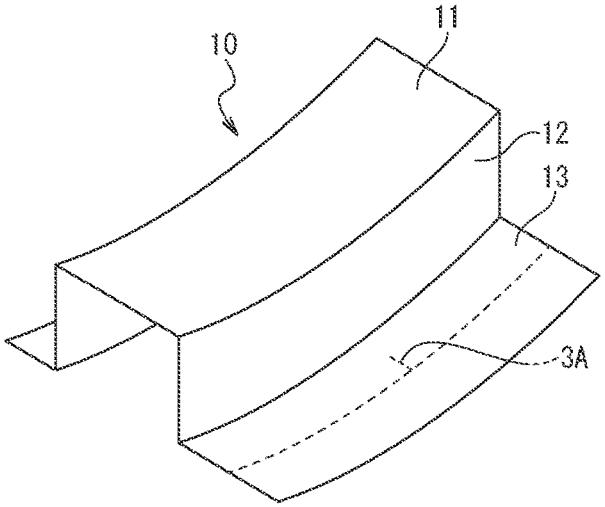
Figure 3E:
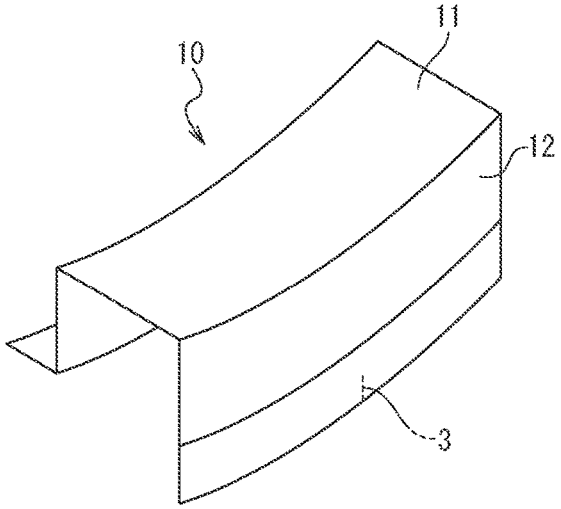
Figure 3C:
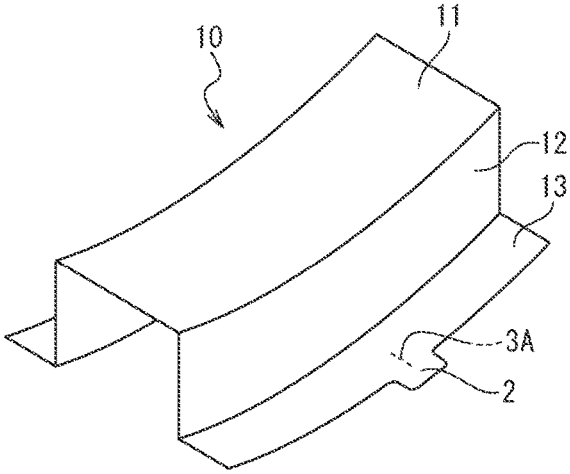

FIGS. 3A to 3E illustrate an example in which the target pressed component (see FIG. 3E) is manufactured in a multi-stage press forming. The example illustrated in FIGS. 3A to 3E is an example in which FIGS. 3B, 3E each illustrates the shape after the press forming and the pressed component in the press forming into the shape of FIG. 3E has the portion with concern about cracking 3 due to the delayed fracture. In this example, the flange portion 13 of the pressed component (FIG. 3B) in the first press forming is cut such that the partial beam-shaped projection portion 2 is formed at the position containing a place where the end cracking is concerned as illustrated in FIG. 3C, and then the projection portion 2 is cut in the second cutting as illustrated in FIG. 3D, so that the target edge profile shape is achieved. Thereafter, the second press forming is performed (see FIG. 3E). This suppresses the end cracking in the portion with concern about cracking 3.

The double cutting processing of the present invention is applicable even to drawing as illustrated in FIGS. 4A to 4D, 5A to 5D. In the example illustrated in FIGS. 4A to 4D, 5A to 5D, the double cutting processing is applied to the portion with concern about cracking due to the delayed fracture before carrying out press forming (FIGS. 4D, 5D) of expanding a central portion by the drawing.

Figure 4A:
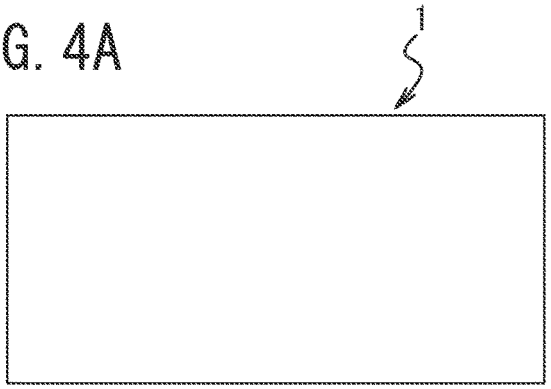
FIGS. 4A to 4D are plan views illustrating, as an example, a case where the double cutting processing based on the present invention is performed for drawing.
Figure 4B:
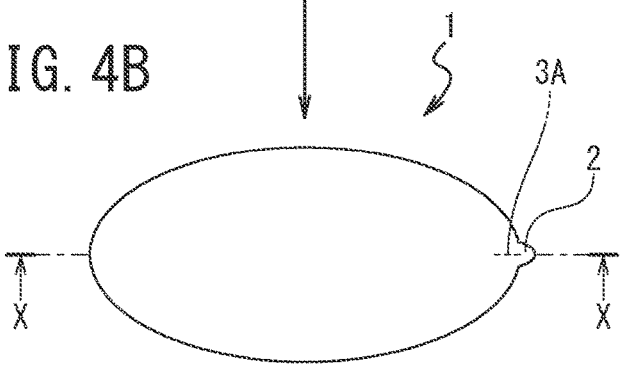
Figure 4C:
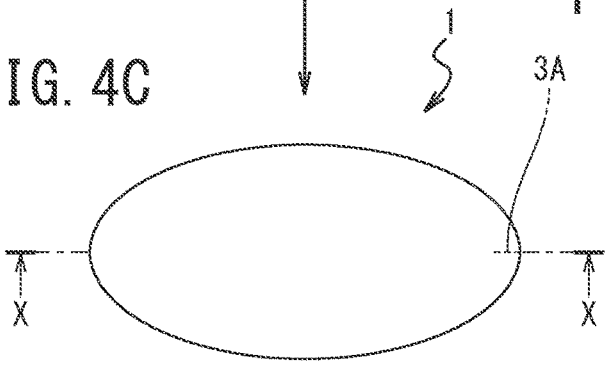
Figure 4C:
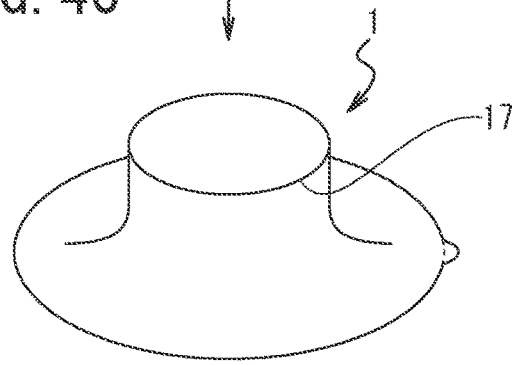
Figure 4D:
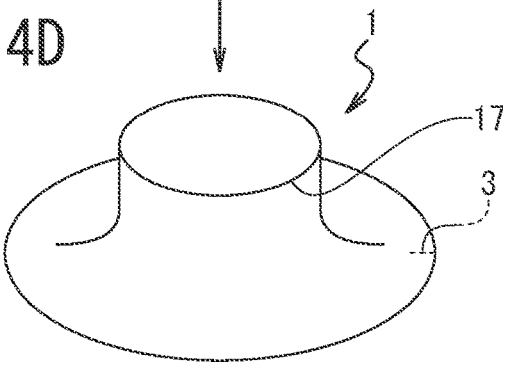
Figure 5A:
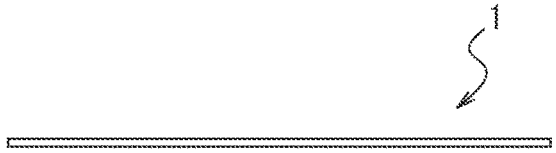
FIGS. 5A to 5D are cross-sectional views illustrating, as an example, the case where the double cutting processing based on the present invention is performed for drawing.
Figure 5B:
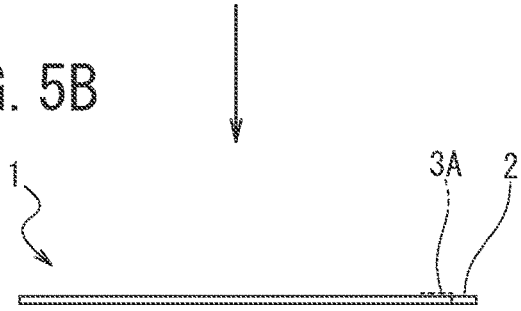
Figure 5C:
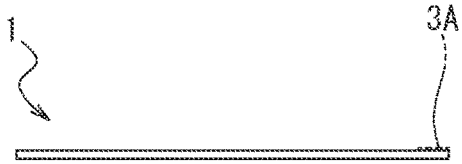
Figure 5C:
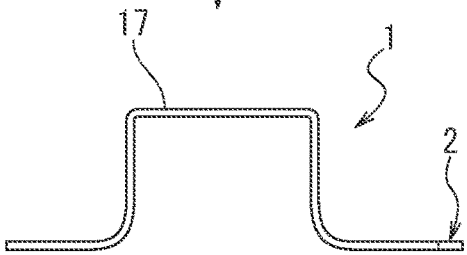
Figure 5D:
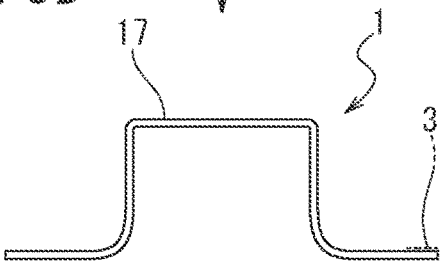

In this example, when the blank 1 is cut into the target sample shape, the beam-shaped projection portion 2 is formed at the position containing the place where the delayed fracture is concerned (FIGS. 4B, 5B). Thereafter, the second cutting is performed to cut the beam-shaped projection portion 2 (FIGS. 4C, 5C).

Thereafter, the drawing is applied to a central portion (FIGS. 4D, 5D) to raise the central portion. The reference numeral 17 designates a part expanded by the drawing. Herein, a cold-rolled material is likely to be cracked in two directions and a hot-rolled material is likely to be cracked in the C direction, i.e., there is a tendency of anisotropy. The above-described projection portion 2 may be formed in the end with the presence of the portion with concern about cracking 3 by the above-described drawing.

The description above is given taking the case where the above-described double cutting processing is carried out as the preprocessing for the drawing as an example. A configuration may be acceptable in which the drawing into the target component shape is performed (FIG. 5, 5C') and then the second cutting (cutting of the projection portion 2) is carried out (FIG. 4, 5D) as illustrated in FIGS. 4,5B→4,5C'→4,5D. The same effects are obtained.

Herein, the double cutting processing is not limited to the trimming step before the press forming described above, and the first cutting and the second cutting may be performed independently from the trimming step as the double cutting processing. When a plurality of press forming steps is provided between the first cutting and the second cutting in the double cutting processing, a configuration may be acceptable in which the double cutting processing is carried out before carrying out at least one press forming among the plurality of press forming steps.

A cutter used for the shearing is not particularly limited, and conventionally known equipment may be used. For example, a clearance C, which is a percentage of a ratio (d/t) of a gap d between an upper blade and a lower blade of the cutter to the sheet thickness t of the material to be pressed, is preferably 5.0% or more and 30.0% or less.

When the clearance C is smaller than 5.0%, a secondary sheared surface is generated in the shearing work, which is not preferable as the state of the sheared end surface. Further, there is a risk of an increase in tensile residual stress.

On the other hand, when the clearance C is larger than 30.0%, there is a risk that a burr equal to or larger than a predetermined burr is generated in the sheared end surface, which greatly impairs the formability of the sheared end surface. Further, non-uniform deformation stress is applied to the worked surface by the end of the shearing work, and therefore there is risk that the tensile residual stress after the end of the shearing work increases.

The clearance C is more preferably 10.0% or more and less than 20.0%.

Example 1

Next, examples relating to this embodiment are described.

Herein, two types of test materials A, B containing a high-strength steel sheet having a sheet thickness of 1.4 mm are targeted. The dimension of the test materials A, B before the shearing is 100 mm×100 mm.

Figure 6A:
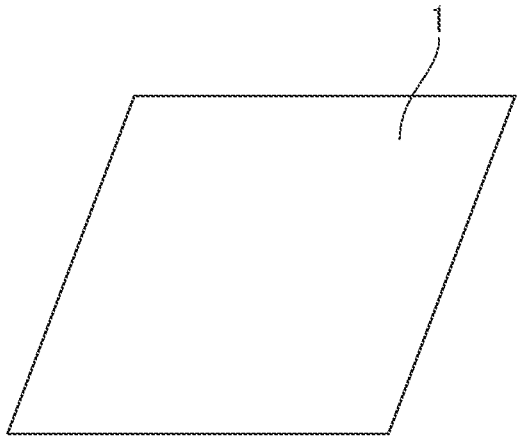
FIGS. 6A to 6C are views for explaining the relationship between the projection amount and a delayed fracture.
Figure 6B:
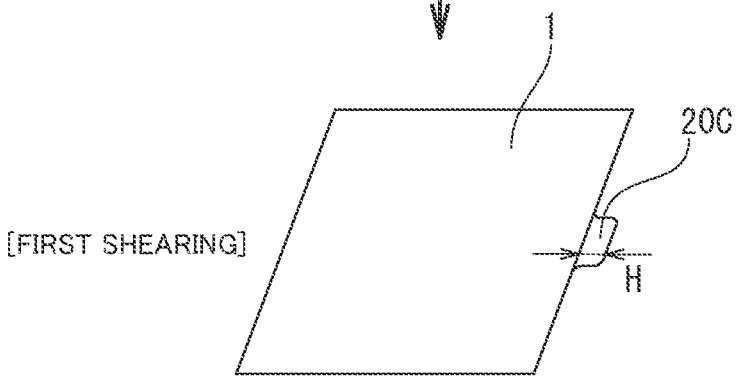

First, the test materials were cut into a dimension of 100 mm×50 mm in the first cutting. In the first cutting, a projection portion 20C was formed (FIG. 6B).

Figure 6C:
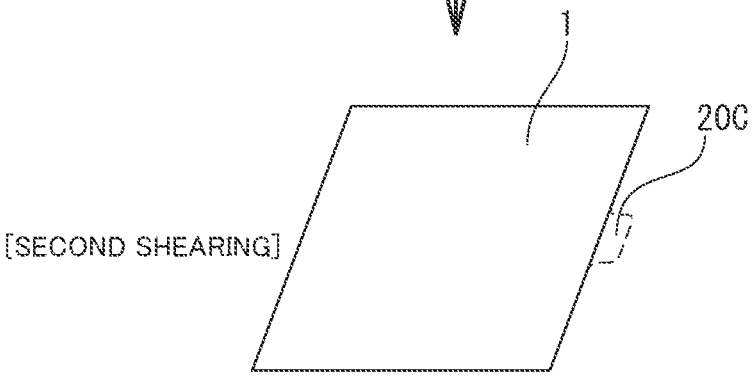

Next, after the first cutting work, second cutting to cut the projection portion 20C was carried out (FIG. 6C). The clearance in the cutting work was set to 12.5% in both the first cutting work and the second cutting work.

The cutting work above was carried out several times while changing the projection amount H of the projection portion 20C, thereby producing a plurality of samples.

After the production of the samples, the measurement of the residual stress of the sheared end surface after the cutting by X-rays in an end surface part where the projection portion 20C was cut was carried out. Further, the produced samples were dipped in hydrochloric acid having a pH of 3 for 96 hours, and then the presence or absence of the end cracking in the samples was confirmed, and the delayed fracture resistance property was evaluated.

The confirmation of cracking was performed by the measurement by X-rays, and the measurement range was set to a diameter of 300 μm. A stress at the center position was measured with respect to both directions of the sheet surface direction and the sheet thickness direction of the sheared end surface after the shearing work.

Table 1 shows the tensile strength, the projection amount H of the projection portion 20C (shown as a ratio to the sheet thickness t), the residual stress of the sheared end surface, and cracking determination results in the dipping test of the test materials.

In Table 1, the samples in which the column of the projection amount H of the projection portion 20C is "-" is an example in which the projection portion 20C was not provided and the second cutting was not carried out.

TABLE 1

| Steel type | Sheet thickness [mm] | Tensile strength [MPa] | First cutting margin [mm] | Projection amount of projection portion (Ratio to metal sheet thickness t) | Residual stress of sheared end surface [MPa] | Occurrence or nonoccurrence of cracking after dipping test |
|---|---|---|---|---|---|---|
| A | 1.4 | 1520 | 50 | — | 1521 | Occurrence |
| | | | | 1.2 | 687 | Nonoccurrence |
| | | | | 2 | 732 | Nonoccurrence |
| | | | | 5 | 651 | Nonoccurrence |
| | | | | 20 | 1414 | Occurrence |
| B | | 1979 | | — | 2003 | Occurrence |
| | | | | 1.2 | 958 | Nonoccurrence |
| | | | | 2 | 920 | Nonoccurrence |
| | | | | 5 | 938 | Nonoccurrence |
| | | | | 20 | 1869 | Occurrence |

As is understood from Table 1, by providing the projection portion 20C in the first cutting work and cutting the cutting projection portion 20C in the second cutting work, the tensile residual stress of the sheared end surface decreases and the cracking determination results of the dipping test also correspond to the decrease.

However, when the cutting margin of the second cutting work was set to 20 times the sheet thickness, an effect of reducing the tensile residual stress is low. Thus, as is understood from Table 1, it was found that the delayed fracture resistance property was greatly improved by setting the projection amount H of the projection portion 20C to 1.2 times or more and less than 20 times the sheet thickness of a metal sheet 10.

Then, when based on the present invention, it was found that the end cracking due to the delayed fracture can be easily suppressed.

Herein, the entire contents of JP 2020-063178 A (filed Mar. 31, 2020), for which this application claims priority, form part of this disclosure by reference. Herein, the description is given with reference to a limited number of embodiments, but the scope of the invention is not limited thereto and modifications of each embodiment based on the disclosure above are obvious to those skilled in the art.

REFERENCE SIGNS LIST

1 blank material (material to be pressed)
1A flange corresponding portion
2, 20C projection portion
3, 3A portion with concern about cracking
10 pressed component
13 flange portion
H projection amount
W width

The invention claimed is:

1. A method for manufacturing a blank material that is to be manufactured into a pressed component through one or two or more times of press forming, the method comprising:

performing a simulation to determine whether or not at least one press forming of the one or two or more times of press forming causes a concern about end cracking due to a delayed fracture at a place at an end of the blank material to be pressed;

determining whether or not there is the concern about end cracking because the place at the end of the blank material is where the delayed fracture has occurred when the simulation is not performed; and performing double cutting processing at the place at the end of the blank material to be pressed after determining from the simulation that there is the concern about end cracking due to the delayed fracture at the place at the end of the blank material to be pressed or after determining that there is the concern about end cracking because the place at the end of the blank material is where the delayed fracture has occurred when the simulation is not performed, wherein the double cutting processing includes performing a first cutting to form a projection portion at a position containing the place at the end of the blank material where the delayed fracture is concerned, and performing a second cutting to cut the projection portion.

2. The method according to claim 1, wherein a width of the projection portion is set to a length of ⅓ or less of a length of an edge of a flange portion that is to be formed from the end of the blank material.

3. The method according to claim 2, wherein a projection amount of the projection portion is set to 10 times or less a sheet thickness of the blank material to be pressed.

4. The method according to claim 3, wherein the one or two or more times of press forming includes stamping or drawing.

5. The method according to claim 2, wherein a projection amount of the projection portion is set to 5.0 mm or less.

6. The method according to claim 5, wherein the one or two or more times of press forming includes stamping or drawing.

7. The method according to claim 2, wherein the one or two or more times of press forming includes stamping or drawing.

8. The method according to claim 1, wherein a width of the projection portion is set to 150 times or less a sheet thickness of the blank material to be pressed.

9. The method according to claim 8, wherein a projection amount of the projection portion is set to 10 times or less the sheet thickness of the blank material to be pressed.

10. The method according to claim 9, wherein the one or two or more times of press forming includes stamping or drawing.

11. The method according to claim 8, wherein a projection amount of the projection portion is set to 5.0 mm or less.

12. The method according to claim 11, wherein the one or two or more times of press forming includes stamping or drawing.

13. The method according to claim 8, wherein the one or two or more times of press forming includes stamping or drawing.

14. The method according to claim 1, wherein a projection amount of the projection portion is set to 10 times or less a sheet thickness of the blank material to be pressed.

15. The method according to claim 14, wherein the one or two or more times of press forming includes stamping or drawing.

16. The method according to claim 1, wherein a projection amount of the projection portion is set to 5.0 mm or less.

17. The method according to claim 16, wherein the one or two or more times of press forming includes stamping or drawing.

18. The method according to claim 1, wherein the one or two or more times of press forming includes stamping or drawing.

* * * * *